US007939124B2

(12) United States Patent
Leenders et al.

(10) Patent No.: US 7,939,124 B2
(45) **Date of Patent: *May 10, 2011**

(54) METHOD OF PRODUCING AN INFORMATION CARRIER

(75) Inventors: Luc Leenders, Herentals (BE); David Terrell, Lint (BE)

(73) Assignee: Agfa-Gevaert, N.V., Mortsel (BE)

( * ) Notice: Subject to any disclaimer, the term of this patent is extended or adjusted under 35 U.S.C. 154(b) by 957 days.

This patent is subject to a terminal disclaimer.

(21) Appl. No.: 11/738,057

(22) Filed: Apr. 20, 2007

(65) Prior Publication Data

US 2008/0136161 A1 Jun. 12, 2008

Related U.S. Application Data

(60) Provisional application No. 60/869,602, filed on Dec. 12, 2006, provisional application No. 60/869,607, filed on Dec. 12, 2006, provisional application No. 60/869,609, filed on Dec. 12, 2006, provisional application No. 60/908,523, filed on Mar. 28, 2007, provisional application No. 60/908,533, filed on Mar. 28, 2007.

(30) Foreign Application Priority Data

| | | |
|---|---|---|
| Dec. 7, 2006 | (EP) | 06125552 |
| Dec. 7, 2006 | (EP) | 06125555 |
| Dec. 7, 2006 | (EP) | 06125558 |
| Mar. 27, 2007 | (EP) | 07104951 |
| Mar. 27, 2007 | (EP) | 07104954 |

(51) Int. Cl.
*B24D 15/00* (2006.01)

(52) U.S. Cl. ..... 427/7; 283/94; 283/72

(58) Field of Classification Search ..... 427/7; 283/94, 283/72

See application file for complete search history.

(56) References Cited

U.S. PATENT DOCUMENTS

| | | | | |
|---|---|---|---|---|
| 2,984,030 | A | 5/1961 | Hannon | |
| 3,279,826 | A | 10/1966 | Rudershausen et al. | |
| 3,332,775 | A | 7/1967 | Mandler | |
| 3,414,998 | A | 12/1968 | Berger | |
| 3,675,948 | A | 7/1972 | Wicker | |
| 3,827,726 | A | 8/1974 | McVoy et al. | |
| 3,961,956 | A | 6/1976 | Fukuda et al. | |
| 4,032,691 | A | 6/1977 | Kido et al. | |
| 4,252,601 | A | 2/1981 | Ceintrey | |
| 4,499,211 | A | 2/1985 | Walch et al. | |
| 5,660,925 | A | 8/1997 | Cooley et al. | |
| 6,364,993 | B1 | 4/2002 | Netsch et al. | |
| 6,723,383 | B2 | 4/2004 | Nigam | |
| 6,837,959 | B2 * | 1/2005 | Daems et al. | 156/269 |
| 2008/0136160 | A1 * | 6/2008 | Leenders | 283/72 |

FOREIGN PATENT DOCUMENTS

| | | | |
|---|---|---|---|
| EP | 0 390 638 | B1 | 10/1990 |
| EP | 1 362 710 | B1 | 11/2003 |
| EP | 1 398 175 | A2 | 3/2004 |
| GB | 1 073 433 | | 6/1967 |
| JP | 10-157280 | A2 | 6/1998 |
| WO | WO 81/01389 | A1 | 5/1981 |
| WO | WO 2004/052655 | A1 | 6/2004 |

* cited by examiner

*Primary Examiner* — Michael Barr
*Assistant Examiner* — Ryan Schiro
(74) *Attorney, Agent, or Firm* — Leydig, Voit & Mayer, Ltd.

(57) ABSTRACT

Methods for producing an information carrier produced by: (1) providing an information carrier precursor comprising a 5 rigid sheet or support; a receiving layer configuration having an image-receiving side and a non-image-receiving side, the receiving layer configuration comprising at least one pigment and at least one binder, (2) pattern-wise or integrally at least partially transparentizing the receiving layer configuration with a vaporizable liquid thereby providing a transparent pattern on the at least partially transparentized receiving layer; (3) using a light source to write a pattern or modify the pattern in the layer or element capable of a machine-readable change upon absorption of UV, visible or IR 25 radiation after transmission through at least part of the transparentized areas of the receiving layer configuration; evaporating the vaporizable liquid, thereby producing an information carrier.

17 Claims, No Drawings

METHOD OF PRODUCING AN INFORMATION CARRIER

CROSS-REFERENCE TO RELATED PATENT APPLICATIONS

This application claims the benefit of U.S. Provisional Application No. 60/869,602 filed Dec. 12, 2006; U.S. Provisional Application No. 60/869,607 filed Dec. 12, 2006; U.S. Provisional Application No. 60/869,609 filed Dec. 12, 2006; U.S. Provisional Application No. 60/908,523 filed Mar. 28, 2007; and U.S. Provisional Application No. 60/908,533 filed Mar. 28, 2007, which are all incorporated by reference. In addition, this application claims the benefit of European Application No. 06125552 filed Dec. 7, 2006; European Application No. 06125555 filed Dec. 7, 2006; European Application No. 06125558 filed Dec. 7, 2006; European Application No. 07104951 filed Mar. 27, 2007; and European Application No. 07104954 filed Mar. 27, 2007, which are all also incorporated by reference.

FIELD OF THE INVENTION

The present invention relates to a method for producing an information carrier.

BACKGROUND OF THE INVENTION

The security field encompasses not only personalized documents such as passports, driving licenses, identity cards (ID cards) and admission documents such as visa's and entry tickets, but also the authentification and identification of goods to avoid counterfeiting, tampering and fraud such as lottery tickets, share certificates, transaction documents, labels on luggage and the packaging of pharmaceuticals and high value products in general.

The term "identity card" encompasses cards requiring bearer identification and range from national identity cards to establish the national identity of their civilians to cards involved in the electronic transfer of money such as bank cards, pay cards, credit cards and shopping cards to security cards authorizing access to the bearer of the card to particular areas such as a company (employee ID card), the military, a public service, the safe deposit departments of banks, etc. to social security cards to membership cards of clubs and societies.

ID cards usually contain information referring both to the authority issuing the card on the one hand and to the owner of the card on the other. The first type of information may be general information such as a name and/or logo of the issuing authority, or security marks, such as a watermark and security print, e.g. a repeating monochrome pattern or a gradually changing colour pattern which are difficult to counterfeit. The second type includes e.g. the unique card number, personal data such as a birth day, a photo of the owner, and a signature. The card can further contain hidden information and therefore contain a magnetic strip or an electronic chip ("smart cards").

A large set of ID cards are usually prepared on a large web or sheet by a step and repeat process, after which the web or sheet is cut into multiple items with the appropriate dimensions each representing a personal ID card. Smart cards and ID cards now have the standardized dimensions of 85.6 mm×54.0 mm×0.76 mm.

Normally, the card is protected by a plastic sheet material for example by lamination of the card to a plastic sheet or, as is usually the case, by lamination between two plastic sheets.

In view of their widespread uses, particularly in commercial transactions such as cashing cheques, credit purchases etc., it is important that the person relying on the ID card to identify the bearer have maximum assurance that the ID card has not been altered and/or that the ID card is not a counterfeit.

The art's response to the counterfeiting problem has involved the integration of "verification features" with ID cards to evidence their authenticity. The best known of these "verification features" involve signatures such as the signature of the one authorized to issue the ID card or the signature of the bearer. Other "verification features" have included the use of watermarks, fluorescent materials, validation patterns or markings and polarizing stripes. These "verification features" are integrated into ID cards in various ways and they may be visible or invisible in the finished card. If invisible, they can be detected by viewing the feature under conditions which render it visible. Details relating to the use of "verification features" in ID cards can be found in U.S. Pat. No. 2,984,030, U.S. Pat. No. 3,279,826; U.S. Pat. No. 3,332,775, U.S. Pat. No. 3,414,998, U.S. Pat. No. 3,675,948, U.S. Pat. No. 3,827,726 and U.S. Pat. No. 3,961,956.

U.S. Pat. No. 4,032,691 discloses a recording material which comprises a support having thereon a highly thermally insulating porous resin layer and a metal, dye or synthetic resin which is thermally deformed, foams, colors, discolors, sublimes, evaporates, or becomes transparent, translucent or opaque when exposed to radiation having a high energy density.

EP-A 1 362 710 discloses a method for producing a tamper proof carrier of information, said method comprising the following steps, in order: (1) providing a two-layer assemblage comprising (i) a rigid sheet or web support, and (ii) a porous opaque ink receiving layer comprising a pigment and a binder whereby either the surface of said support, or the surface of said opaque layer carries a first set of printed information, (2) printing a second set of information, different from said first set, onto said porous opaque ink receiving layer by means of ink jet printing, (3) covering totally, partially, or pattern-wise the thus obtained assemblage with a UV-curable lacquer composition, by means of coating, printing, spraying or jetting, whereby on penetration of the lacquer in said porous opaque ink receiving layer this layer becomes substantially transparent, (4) curing said lacquer composition by means of an overall UV exposure, thereby improving the adhesion between said support and said ink receiving layer, and the cohesive strength of said ink receiving layer.

EP-A 1 398 175 discloses four different embodiments of an information carrier. In the first embodiment the information carrier comprising: a rigid sheet or web support; an opaque porous receiving layer capable of being rendered substantially transparent by penetration by a lacquer, said receiving layer containing a pigment and a binder; an image provided onto and/or in said receiving layer; a cured pattern of a varnish provided onto said receiving layer provided with said image or onto and/or in said receiving layer provided with said image if said varnish is incapable of rendering said receiving layer transparent; and a cured layer of said lacquer provided on said receiving layer provided with said image and said cured pattern of said varnish, said lacquer having rendered said parts of said receiving layer in contact therewith substantially transparent, wherein said cured pattern of said varnish forms an opaque watermark. In the second embodiment the information carrier comprising: a rigid sheet or web support; an opaque porous receiving layer capable of being rendered substantially transparent by penetration by a varnish, said receiving layer containing a pigment and a binder; an image provided onto and/or in said receiving layer; a cured pattern of said varnish provided in said receiving layer provided with said image; and a cured layer of a lacquer provided onto said receiving layer provided with said image and said cured pattern of said varnish, or onto and/or in said receiving layer provided with said image and said cured pattern of said varnish if said lacquer is incapable of rendering said receiving layer transparent, said varnish having rendered said parts of said receiving layer in contact therewith substantially transparent, wherein said cured pattern of said lacquer forms a substantially transparent watermark. In the third embodiment the information carrier comprising: a rigid sheet or web support; a transparent porous receiving layer capable of being rendered substantially opaque by penetration by a lacquer, said receiving layer containing a pigment and a binder; an image provided onto and/or in said receiving layer; a cured pattern of a varnish provided onto said receiving layer provided with said image, or onto and/or in said receiving layer provided with said image if said varnish is incapable of rendering said receiving layer opaque; and a cured layer of said lacquer provided on said receiving layer provided with said image and said cured pattern of said varnish, said lacquer having rendered said parts of said receiving layer in contact therewith substantially opaque, wherein said cured pattern of said varnish forms a transparent watermark. In the fourth embodiment the information carrier comprising: a rigid sheet or web support; a transparent porous receiving layer capable of being rendered substantially opaque by penetration by a varnish, said receiving layer containing a pigment and a binder; an image provided onto and/or in said receiving layer; a cured pattern of said varnish provided in said receiving layer provided with said image; and a cured layer of a lacquer provided onto said receiving layer provided with said image and said cured pattern of said varnish, or onto and/or in said receiving layer provided with said image and said cured pattern of said varnish if said lacquer is incapable of rendering said receiving layer opaque, said varnish having rendered said parts of said receiving layer in contact therewith substantially opaque, wherein said cured pattern of said lacquer forms a substantially opaque watermark.

GB 1 073 433 discloses the method of forming an image on a porous, opaque layer comprising applying an imaging material in imagewise configuration which is of similar refractive index to the opaque layer and reducing the viscosity of said imaging material so that it flows into the pores to fill the pores of said opaque layer to render said opaque layer clear in said image areas.

U.S. Pat. No. 4,252,601 discloses an information recording kit for making transparencies for projection of information or for making photographic negatives for reproductions comprising an opaque recording material, a writing liquid for recording information on the recording material and means for applying the writing liquid on the opaque recording material in the form of transparent lines wherein said recording material comprises a transparent backing sheet and an opaque layer adhered to one surface of said backing sheet, said opaque layer comprising a finely divided particulate organic styrene resin pigment uniformly distributed throughout a polyvinylidene chloride film-forming resin binder, said writing liquid comprising a solvent for the organic styrene resin pigment, whereby when said writing liquid is applied to said opaque layer according to a pattern of information the opaque layer becomes transparent to visible light according to said pattern.

WO 81/01389A1 discloses a self-supporting microvoid-containing sheet material which is substantially insensitive to marking by the localized application of heat or pressure but which is receptive to ink, pencil, crayon or similar markings and which is adapted to being temporarily or permanently provided with markings by the application of a colorless liquid, comprising in combination: a self-supporting base sheet and, bonded over at least one side of said base sheet, a reflective opaque white to pastel layer comprising particles bonded by a binder, said particles and binder both having a refractive index in the range of 1.3 to 2.2, interconnected microvoids being present throughout said layer, characterized in that the binder:particle volume ratio being in the range of about 1:20 to 2:3, so that the particles are held in pseudo-sintered juxtaposition, the void volume of the layer being in the range of 15-70%, said binder being thermoset, and layer having an image force of at least 200 grams-force.

U.S. Pat. No. 4,499,211 discloses a microporous molded article having an open-cell structure and comprising a thermoplastic material which possesses an inherent latent structural convertibility and includes effective pores of a diameter in the range from about 0.002 to 10 μm, said thermoplastic material comprising at least about 70 percent by weight of a terpolymer which is composed of from about 20 to 80 percent by weight, relative to the total weight of the terpolymer, of copolymerized fluorinated olefin selected from the group consisting of ethylene and propylene, up to about 40 percent by weight, relative to the total weight of the terpolymer, of copolymerized olefin selected from the group consisting of ethylene and propylene, and from about 80 to 20 percent by weight, relative to the total weight of the copolymer, of copolymerized vinyl acetate, with at least 5 percent of the total proportion of acetate groups contained in the copolymer being converted by saponification into OH groups after copolymerization of the specified comonomers to form the terpolymer.

EP-A 0 390 638 discloses a base sheet comprising a layer capable of becoming, in reversible manner, transparent by contact with a liquid, resistant to a marking by localized application of pressure and/or heat, characterized by the fact that it comprises: at least one flexible sheet, at least one layer applied in aqueous form on the flexible sheet and then dried, said sheet being microporous, opaque, and containing at least non-thermoset particles, at least one binder and optionally other additives.

JP 10-157280A discloses a recording material capable of being printed repeatedly by ink jet printing without deteriorating its recording performance even in the case of using many times by incorporating mat or porous surface and a solvent receiving layer which becomes opaque when no solvent exists and transparent when solvent is received.

U.S. Pat. No. 5,660,925 discloses an authenticatible, tamper-indicating label, comprising: a normally opaque, transparentizable microporous film having first and second major surfaces, a first indicia proximate said first surface a second indicia on said first surface, and an adhesive proximate said first surface; wherein said microporous film can be changed from an opaque state to a transparent state by application of a first liquid that is not a solvent for said first and second indicia to said microporous film to thereby sufficiently fill the pores of said microporous film to cause said film to become transparent; wherein when said microporous film is in its opaque state, said first and second indicia are not visually perceptible when said label is viewed from said second surface, and when said microporous film is in its transparent state, at least said first indicia is visually perceptible when said label is viewed from said second surface, thereby providing an indication of the authenticity of said label; and wherein application of a second liquid that is a solvent for said second indicia causes at least a portion of said second indicia to migrate through said microporous film to said second major surface, thereby providing a permanent visually perceptible indication of tampering.

U.S. Pat. No. 6,364,993 discloses a laminate comprising a substrate having a first substrate surface containing an image thereon and a polymeric film laminated to said first substrate surface overlying said image, said film containing an exposed water activatable opaque layer having a thickness ranging from about 0.6 mil to about 2.0 mil, said opaque layer derived from a coating formulation comprising from about 5 to about 40 wt. % aluminum silicate and from about 60 to about 95 wt. % binder, wherein the binder comprises a mixture of solvent, butyl acetate, ethylene glycol monobutyl ether and propylene glycol.

U.S. Pat. No. 6,723,383 discloses a process for producing a dry image comprising the steps of: (a) applying an opaque coating composition to the surface of a substrate to form an opaque coating on the substrate, wherein the surface is selected from the group consisting of a light-emitting surface, a reflective surface, a glossy surface, a luminescent surface, and a combination thereof; and (b) contacting the coated substrate with a recording liquid, wherein the opaque coating composition includes an opaque coating agent comprising a polymeric polyacid and a polymeric polybase, and wherein the opaque coating contacted with the recording liquid becomes transparent as a result of the contact.

WO 04/052655A1 discloses a multi-layer opaque and matte ink-jet recording medium, suitable for recording images with dye and pigmented inks, which goes through phase change from opaque to transparent and glossy in at least one printed area to reveal the surface of a substrate and thereby provide light-emitting, reflective, glossy, metallic-looking images or to show holographic images, wherein the recording medium comprises a substrate coated with at least two chemically layers comprising: (a) a first transparent ink-receptive layer comprising a polymeric binder and a cross-linker and optionally having a plasticizer and pigment particles such as alumina and silica coated over the substrate, wherein the cross-linker comprises an azetidinium polymer or a salt thereof, and/or a polyfunctional aziridine or a salt thereof, or a polyfunctional oxazoline and metallic salts; and (b) a second ink-receptive layer comprising an opaque or semi-opaque coating composition, wherein the opaque or semi-opaque coating composition is capable of accepting a printed image and thereby becoming semi-transparent or clearly transparent from application of ink-jet printing ink or similar inks, while presenting a light-emitting, reflective, glossy, metallic-looking or holographic or transparent image of high clarity and quality, wherein said first layer is located between said second layer and the substrate in said recording medium and the first and second layer are chemically coupled.

The inventions of EP-A 1 362 710 and EP-A 1 398 175 both disclose a porous opaque ink receiving layer comprising a pigment and a binder, which is capable of being transparentized with a UV-curable lacquer. There is a need to extend the security possibilities for providing additional security features to the information carriers disclosed in EP-A 1 362 710 and EP-A 1 398 175. There is also the need for the possibility of personalizing the information carrier i.e. incorporating personal details of the information card carrier e.g. an image or other identification. In particular, it has hitherto not been possible to personalize machine readable information covered by an opaque layer with a process which enables the personalization process to be carried out locally.

ASPECTS OF THE INVENTION

It is an aspect of the present invention to provide information carriers with transparentizable opaque porous layers with additional security features.

It is a further aspect of the present invention to provide information carriers with transparentizable opaque porous layers with additional security features, which are capable of being individualized by the incorporation of details of the person or object associated with the information carrier.

Further aspects and advantages of the present invention will become apparent from the description hereinafter.

SUMMARY OF THE INVENTION

Surprisingly it has been found that the writing or modification of machine readable information can be realized in a layer or element, or pattern in the layer or element, capable of machine readable change covered by an opaque porous layer. This is achieved by temporarily transparentizing the opaque porous layer with a liquid and in the resulting transparentized state using a visible, UV or IR light source to modify or write the machine-readable information in the layer or element capable of machine readable change or in a pattern in the layer or element. Evaporation of the liquid then restores the opacity of the covering layer and this opacity can be rendered permanent by penetration by a lacquer, which does not transparentize the opaque porous layer, with optional subsequent curing, thereby realizing machine readable information which can no longer be changed.

Aspects of the present invention are realized by a method for producing an information carrier comprising the steps of: (1) providing an information carrier precursor comprising a rigid sheet or support; a receiving layer configuration having an image-receiving side and a non-image-receiving side, the receiving layer configuration comprising at least one pigment and at least one binder, wherein at least one constituent layer of the receiving layer configuration is opaque; at least the outermost layer on the image-receiving side or a layer in diffusive contact with the outermost layer on the image-receiving side is opaque and porous; and the receiving layer configuration is capable of being rendered substantially transparent by penetration by a lacquer; and a layer or element, or pattern in the layer or element, capable of a machine-readable change upon absorbing UV, visible or IR radiation, the layer or element being either the surface of the rigid sheet or support or interposed between the rigid sheet or support and the non-image-receiving side of the receiving layer configuration; (2) pattern-wise or integrally at least partially transparentizing the receiving layer configuration with a vaporizable liquid thereby providing a transparent pattern on the at least partially transparentized receiving layer; (3) using a light source to write a pattern or modify the pattern in the layer or element capable of a machine-readable change upon absorption of UV, visible or IR radiation after transmission through at least part of the transparentized areas of the receiving layer configuration; evaporating the vaporizable liquid; and after the vaporizable liquid has been evaporated pattern-wise or integrally rendering the receiving layer configuration permanently at least partially non-transparent with a non-transparentizing lacquer, thereby producing an information carrier.

Further aspects of the present invention are disclosed in the dependent claims.

DETAILED DESCRIPTION

Definitions

The term "information carrier precursor", as used in disclosing the present invention, means an intermediate product used in the realization of information carriers.

The term "porous layer", as used in disclosing the present invention, means a layer with pores, which can be in the ingredients of the layer and/or in addition to the ingredients of the layer e.g. a layer containing a porous ingredient is a porous layer.

The terms "opaque" and "non-transparent" layer, as used in disclosing the present invention, refer to a layer where less than 10% of the incident light is allowed to pass through the layer. In a "substantially transparent" layer at least 50% of the incident visible light, preferably more than 65 and particularly preferably more than 75%, passes through the layer.

The term "non-transparentizing lacquer", as used in disclosing the present invention, means a liquid under the application conditions, which comprises at least one polymer and/or at least one wax and/or at least one polymerizable substance (e.g. monomers and oligomers) and can solidify upon cooling, become solid upon evaporation of solvent or harden/cross-link upon exposure to moisture or radiation e.g. visible light, UV-radiation and electron beams i.e. is curable which does not transparentize the receiving layer configuration.

The term "transparentizing lacquer", as used in disclosing the present invention, means a liquid under the application conditions, which comprises at least one polymer and/or at least one wax and/or at least one polymerizable substance (e.g. monomers and oligomers) and can solidify upon cooling, become solid upon evaporation of solvent or harden/cross-link upon exposure to heat, moisture or radiation e.g. visible light, UV-radiation and electron beams i.e. is curable which transparentizes the receiving layer configuration The term "capability of being rendered substantially transparent by a "vaporizable liquid", as used in disclosing the present invention, means that the receiving layer configuration at least becomes transparent upon penetration of the liquid and is maintained as long as the liquid is present.

The term "at least partially non-transparent", as used in disclosing the present invention, means not completely non-transparent but insufficiently non-transparent to prevent the pattern in the layer or element capable of a machine-readable change upon absorbing UV, visible or IR radiation being changed by UV, visible or IR radiation.

The terms "on", "onto" and "in", as used in disclosing the present invention, have very precise meanings with respect to a layer: "on" means that penetration of the layer may or may not occur, "onto" means at least 90% on the top of i.e. there is no substantial penetration into the layer, and "in" means that penetration into the respective layer or layers occurs. With printing digitally stored information "onto" a porous receiving layer configuration, we understand that an image is provided "on and/or in" the receiving layer configuration. In the case of ink jet printing, if the ink remains on top of the receiving layer configuration, the image is provided "onto" the receiving layer. If the ink penetrates into the porous receiving layer configuration, it is "in" the layer The term "conventional printing process", as used in disclosing the present invention refers to impact printing processes as well as to non-impact printing processes. The term includes but is not restricted to ink-jet printing, intaglio printing, screen printing, flexographic printing, driographic printing, electrophotographic printing, electrographic printing, offset printing, stamp printing, gravure printing, thermal and laser-induced processes and also includes a printing process rendering areas of a conductive layer non-conductive in a single pass process, such as disclosed in EP 1 054 414A and WO 03/025953A, but excludes processes such as evaporation, etching, diffusion processes used in the production of conventional electronics e.g. silicon-based electronics.

The term "impact printing process", as used in disclosing the present invention, means a printing process in which contact is made between the medium in which the print is produced and the printing system e.g. printers that work by striking an ink ribbon such as daisy-wheel, dot-matrix and line printers, and direct thermal printers in which the thermographic material is printed by direct contact with heating elements in a thermal head and printers in which a master is covered with an ink layer on areas corresponding to a desired image or shape, after which the ink is transferred to the medium, such as offset, gravure or flexographic printing.

The term "non-impact printing process", as used in disclosing the present invention, means a printing process in which no contact is made between the medium in which the print is produced and the printing system e.g. electrographic printers, electrophotographic printers, laser printers, ink jet printers in which prints are produced without needing to strike the print medium.

The term "pattern", as used in disclosing the present invention, includes holograms, images, representations, guilloches, graphics and regular and irregular arrays of symbols, images, geometric shapes and non-geometric shapes and can consist of pixels, continuous tone, lines, geometric shapes and/or any random configuration.

The term "pattern-wise", as used in disclosing the present invention, means as a pattern and embraces the term image-wise.

The term "layer", as used in disclosing the present invention, means a coating covering the whole area of the entity referred to e.g. a support.

The term "discontinuous layer", as used in disclosing the present invention, means a coating not covering the whole area of the entity referred to e.g. a support.

PET is an abbreviation for polyethylene terephthalate.

PETG is an abbreviation for polyethylene terephthalate glycol, the glycol indicating glycol modifiers which are incorporated to minimize brittleness and premature aging that occur if unmodified amorphous polyethylene terephthalate (APET) is used in the production of cards.

Method for Producing an Information Carrier

Aspects of the present invention are realized by a method for producing an information carrier comprising the steps of: (1) providing an information carrier precursor comprising a rigid sheet or support; a receiving layer configuration having an image-receiving side and a non-image-receiving side, the receiving layer configuration comprising at least one pigment and at least one binder, wherein at least one constituent layer of the receiving layer configuration is opaque; at least the outermost layer on the image-receiving side or a layer in diffusive contact with the outermost layer on the image-receiving side is opaque and porous; and the receiving layer configuration is capable of being rendered substantially transparent by penetration by a lacquer; and a layer or element, or pattern in the layer or element, capable of a machine-readable change upon absorbing UV, visible or IR radiation, the layer or element being either the surface of the rigid sheet or support or interposed between the rigid sheet or support and the non-image-receiving side of the receiving layer configuration; (2) pattern-wise or integrally at least partially transparentizing the receiving layer configuration with a vaporizable liquid thereby providing a transparent pattern on the at least partially transparentized receiving layer; (3) using a light source to write a pattern or modify the pattern in the layer or element capable of a machine-readable change upon absorption of UV, visible or IR radiation after transmission through at least part of the transparentized areas of the receiving layer configuration; evaporating the vaporizable liquid; and after the vaporizable liquid has been evaporated pattern-wise or integrally rendering the receiving layer configuration permanently at least partially non-transparent with a non-transparentizing lacquer, thereby producing an information carrier.

Vaporizable transparentizing liquids include water, organic solvents, mixtures of water with organic solvents and solvent mixtures. Selection is dependent upon the refractive index of the liquid, its ease of evaporation, its viscosity and its ability to wet the pores in the receiving layer configuration and therefore enable penetration of the receiving layer configuration. If the pores have a hydrophilic character, hydrophilic liquids with the requisite refractive index will be required and if the pores have a hydrophobic character, hydrophobic liquids with the requisite refractive index will be required. The refractive index should differ from that of the pigment used in the receiving layer configuration by no more than 0.1, with a difference of 0.04 being preferred and a difference of 0.02 being particularly prepared.

If porous silica e.g. silica gel is used as a pigment in the receiving layer configuration, the following vaporizable liquids are suitable for obtaining temporary transparentization:

| | Boiling point [° C.] | Refractive index at 20° C. with sodium line at 589.3 nm |
|---|---|---|
| 2-butanol | 99.5 | 1.397 |
| n-butyl acetate | 126.1 | 1.394 |
| chloroform | 61.2 | 1.4458 |
| cyclohexane | 80.7 | 1.426 |
| cyclopentane | 49.3 | 1.406 |
| dichloromethane | 39.8 | 1.4241 |
| diethylene glycol | 244.8 | 1.4475 |
| 1,4-dioxane | 101.0 | 1.4224 |
| ethylene glycol | 198.9 | 1.4318 |
| methylethylketone | 79.6 | 1.379 |
| N-methyl-2-pyrrolidone | 202.0 | 1.488 |
| heptane | 98.4 | 1.3878 |
| Isobutyl alcohol | 107.9 | 1.396 |
| octane | 125.7 | 1.3974 |
| tetrachloroethylene | 121.2 | 1.506 |
| tetrahydrofuran | 66.0 | 1.4072 |
| toluene | 110.6 | 1.497 |
| trichloroethylene | 87.0 | 1.4767 |
| 2,2,4-trimethylpentane | 99.2 | 1.391 |
| water | 100 | 1.333 |

According to a first embodiment of the method for producing an information carrier, according to the present invention, the method further comprises applying a permanent pattern to the outermost layer of the receiving layer configuration.

According to a second embodiment of the method for producing an information carrier, according to the present invention, the method further comprises applying a permanent pattern to the outermost layer of the receiving layer configuration and the permanent pattern is applied to the outermost surface of the receiving layer using a conventional printing technique, with non-impact printing or impact printing being preferred and ink-jet printing being particularly preferred.

According to a third embodiment of the method for producing an information carrier, according to the present invention, the method further comprises applying a permanent pattern to the outermost layer of the receiving layer configuration and the method of applying a permanent pattern to the outermost surface of the receiving layer configuration is a non-impact printing technique selected from the group consisting of electrophotographic printing, electrophoretic printing and ink-jet printing.

According to a fourth embodiment of the method for producing an information carrier, according to the present invention, the method further comprises applying a permanent pattern to the outermost layer of the receiving layer configuration and the method of applying a coloured permanent pattern to the outermost surface of the receiving layer configuration is an impact printing technique selected from the group consisting of thermal dye sublimation printing, thermal dye transfer printing, screen printing, offset printing, gravure printing and flexographic printing.

According to a fifth embodiment of the method for producing an information carrier, according to the present invention, the method further comprises applying a permanent pattern to the outermost layer of the receiving layer configuration and the permanent pattern is applied using a conventional printing process only to the opaque, porous parts of the outermost layer of the receiving layer configuration remaining after permanent pattern-wise transparentization.

According to a sixth embodiment of the method for producing an information carrier, according to the present invention, the method further comprises applying a pattern to the outermost layer of the receiving layer configuration and the application of the pattern to the outermost layer is performed subsequent to the writing or the modifying of the pattern in the layer or element capable of a machine-readable change upon absorption of UV, visible or IR radiation.

According to a seventh embodiment of the method for producing an information carrier, according to the present invention, the light source is a laser.

According to an eighth embodiment of the method for producing an information carrier, according to the present invention, a hologram is written on or applied to the outermost surface of the information carrier.

According to a ninth embodiment of the method for producing an information carrier, according to the present invention, an embossable layer is applied to the outermost surface of the information carrier and the embossable layer is then embossed e.g. as a hologram.

According to a tenth embodiment of the method for producing an information carrier, according to the present invention, a UV-hardenable black image is printed on the outermost surface of the information carrier and the black image is UV-hardened to form a relief image.

According to an eleventh embodiment of the method for producing an information carrier, according to the present invention, a metal fibre or strip is applied to the outermost surface of the information carrier in a hardenable composition.

When the information carrier is meant to be cut later on in multiple identity cards the security print is repeatedly applied over multiple areas of the web or sheet by a step and repeat process thus giving rise to multiple identical items. These multiple identical items are distributed over the support according to a fixed pattern, e.g. a rectangular grid.

According to a twelfth embodiment of the method for producing an information carrier, according to the present invention, the method further comprises applying a permanent pattern to the outermost layer of the receiving layer configuration and the permanent pattern applied to the outermost layer of the receiving layer configuration is a digitally stored set of information, applied, for example, by means of ink jet printing, thermal dye sublimation printing or thermal dye transfer printing. Printing techniques using toner particles can however also be used.

According to a thirteenth embodiment of the method for producing an information carrier, according to the present invention, the method further comprises applying a permanent pattern to the outermost layer of the receiving layer configuration and the permanent pattern applied to the outermost layer of the receiving layer configuration is a digitally stored set of information, which is personalized information different for each individual item present on the information carrier. For instance, this personalized information may be a unique individual card number assigned to the future bearer of the card, or the expiry date of the validity of the card, or personal data of the future bearer, e.g. a date of birth, and/or a photo. Again, when the information carrier is meant to be cut in multiple ID cards, the ink jet printing step is repeated over multiple areas of the support in register with the security print pattern when present, thereby providing each item with different personalized information.

When the information carrier is meant to be cut in multiple ID cards, the application and curing of the varnish is repeated over multiple areas of the information carrier fully or partially in register with the multiple different items already present consisting of optional security print and personalized information.

According to a fourteenth embodiment of the method for producing an information carrier, according to the present invention, the pattern-wise or integrally at least partial non-transparentization of the receiving layer configuration is carried out by coating, printing, spraying or jetting a lacquer composition on the outermost surface of the receiving layer configuration, with the lacquer preferably being curable and particularly preferably being radiation curable e.g. UV-curable. In the case of pattern-wise at least partial transparentization, the at least partial transparentization is preferably carried out by ink-jet printing. As explained above the better the match of the refraction indices of the lacquer composition and the pigment in the receiver layer the better the transparency.

Apparatuses for UV-curing are known to those skilled in the art and are commercially available. For example, UV-curing can be carried out with medium pressure mercury vapour lamps with or without electrodes, or pulsed xenon lamps. These ultraviolet light sources are usually equipped with a cooling installation, an installation to remove the ozone produced and optionally a nitrogen inflow to exclude air from the surface of the product to be cured during radiation processing. A UV-light intensity of 40 to 240 W/cm in the 200-400 nm spectral region is usually employed. An example of a commercially available UV-curing unit is the DRSE-120 conveyor from Fusion UV Systems Ltd., UK with a VPS/1600 UV lamp, an ultraviolet medium-pressure electrodeless mercury vapour lamp. The DRSE-120 conveyor can operate at different transport speeds and different UV power settings over a width of 20 cm and a length in the transport direction of 0.8 cm. Moreover, it can also be used with metal halide-doped Hg vapour or XeCl excimer lamps, each with its specific UV emission spectrum. This permits a higher degree of freedom in formulating the curing composition: a more efficient curing is possible using the lamp with the most appropriate spectral characteristics. A pulsed xenon flash lamp is commercially available from IST Strahlentechnik GmbH, Nürtingen, Germany.

As a result of the curing the cohesive force of the receiving layer configuration and the adhesive force between the receiver and the support are strongly improved rendering in this way the information carrier tamper proof since it has become strongly resistant to mechanical and chemical influences.

Ink-Jet Inks

Ink compositions for ink jet typically include following ingredients: dyes or pigments, water and/or organic solvents, humectants such as glycols, detergents, thickeners, polymeric binders, preservatives, etc. It will be readily understood that the optimal composition of such an ink is dependent on the ink jetting method used and on the nature of the substrate to be printed. The ink compositions can be roughly divided into:

- water based: drying mechanism involves absorption, penetration and evaporation;
- oil based: drying involves absorption and penetration;
- solvent based: drying mechanism involves primarily evaporation;
- hot melt or phase change: the ink vehicle is liquid at the ejection temperature but solid at room temperature; drying is replaced by solidification;
- UV-curable: drying is replaced by photopolymerization.

The colorants present in the ink jet ink may be dyes which are molecularly dissolved in the ink fluid, e.g. acid dyes which are bound by a cationic mordant in the ink receiver, or they may be pigments which are finely dispersed in the ink fluid.

Information Carrier Precursor

The methods for producing an information carrier, according to the present invention, use an information carrier precursor comprising a rigid sheet or support; a receiving layer configuration comprising a single layer or multiple layers, each layer comprising at least one binder and at least one pigment, the receiving layer configuration being opaque and porous and capable of being transparentized by penetration with a vaporizable liquid; a layer or element capable of a machine-readable change upon absorbing radiation; and optionally an opaque element between the side of the receiving layer configuration closer to the support and the support, which may be contiguous or non-contiguous with the side of the receiving layer configuration closer to the support.

According to a fifteenth embodiment of the method for producing an information carrier, according to the present invention, the information carrier precursor further comprises an opaque element between the side of the receiving layer configuration nearer the support and the support.

Receiving Layer Configuration

The receiving layer configuration comprises at least one pigment and at least one binder, wherein at least one constituent layer of the receiving layer configuration is opaque; at least the outermost layer on the image-receiving side or a layer in diffusive contact with the outermost layer on the image-receiving side is opaque and porous; and the receiving layer configuration is capable of being rendered substantially transparent by penetration by a lacquer. Such opaque and porous layers preferably comprise at least one pigment and at least one binder.

Multiple layers comprising the receiving layer configuration can be coated or printed simultaneously or sequentially and may have the same or different compositions e.g. to vary the porosity of the individual layers.

The receiving layer configuration may be coated onto the support by any conventional coating technique, such as dip coating, knife coating, extrusion coating, spin coating, slide hopper coating and curtain coating, and any conventional printing technique, such as screen printing, offset printing, ink-jet printing, gravure printing and intaglio printing.

The composition of individual layers in the receiving layer configuration can be modified after deposition by coating or printing by, for example, pattern-wise or non-pattern-wise deposition of a substance in a form which can mix with, e.g. upon partial dissolution of the uppermost part of the layer, or diffuse into layer.

The constituent receiving layers and the optional supplementary layers used in the information carrier precursor, according to the present invention, may further contain well-known conventional ingredients, such as surfactants serving as coating aids, hardening agents, plasticizers, whitening agents and matting agents.

Suitable surfactants are any of the cationic, anionic, amphoteric, and non-ionic ones as described in JP-A 62-280068 (1987). Examples of the surfactants are N-alkylamino acid salts, alkylether carboxylic acid salts, acylated peptides, alkylsulphonic acid salts, alkylbenzene and alkylnaphthalene sulphonic acid salts, sulfosuccinic acid salts, α-olefin sulphonic acid salts, N-acylsulphonic acid salts, sulphonated oils, alkylsulphonic acid salts, alkylether sulphonic acid salts, alkylallylethersulphonic acid salts, alkylamidesulphonic acid salts, alkylphosphoric acid salts, alkyletherphosphoric acid salts, alkylallyletherphosphoric acid salts, alkyl and alkylallylpolyoxyethylene ethers, alkylallyl-formaldehyde condensed acid salts, alkylallylethersulphonic acid salts, alkylamidesulphonic acid salts, alkylphosphoric acid salts, alkyletherphosphoric acid salts, alkylallyletherphosphoric acid salts, alkyl and alkylallylpolyoxy-ethylene ethers, alkylallyl-formaldehyde condensed polyoxyethylene ethers, blocked polymers having polyoxypropylene, polyoxyethylene polyoxypropylalkylethers, polyoxyethyleneether of glycolesters, polyoxyethylene ether of sorbitan esters, polyoxyethylene ether of sorbitol esters, polyethyleneglycol aliphatic acid esters, glycerol esters, sorbitane esters, propyleneglycol esters, sugar esters, fluoro $C_2$-$C_{10}$ alkylcarboxylic acids, disodium N-perfluorooctanesulfonyl glutamate, sodium 3-(fluoro-$C_6$-$C_{11}$-alkyloxy)-1-$C_3$-$C_4$ alkyl sulfonates, sodium 3-(ω-fluoro-$C_6$-$C_8$-alkanoyl-N-ethylamino)-1-propane sulphonates, N-[3-(perfluorooctanesulfonamide)-propyl]-N,N-dimethyl-N-carboxy-methylene ammonium betaine, fluoro-$C_{11}$-$C_{20}$ alkylcarboxylic acids, perfluoro-$C_7$-$C_{13}$-alkyl-carboxylic acids, perfluorooctane sulfonic acid diethanolamide, Li, K and Na perfluoro-$C_4$-$C_{12}$-alkyl sulphonates, N-propyl-N-(2-hydroxyethyl)perfluorooctane sulphonamide, perfluoro-$C_6$-$C_{10}$-alkylsulphonamide-propyl-sulphonyl-glycinates, bis-(N-perfluorooctylsulphonyl-N-ethanolaminoethyl)-phosphonate, mono-perfluoro $C_6$-$C_{16}$ alkyl-ethyl phosphonates, and perfluoroalkylbetaine.

Useful cationic surfactants include N-alkyl dimethyl ammonium chloride, palmityl trimethyl ammonium chloride, dodecyldimethyl-amine, tetradecyldimethylamine, ethoxylated alkyl guanidine-amine complex, oleamine hydroxypropyl bistrimonium chloride, oleyl imidazoline, stearyl imidazoline, cocamine acetate, palmitamine, dihydroxyethylcocamine, cocotrimonium chloride, alkyl polyglycol-ether ammonium sulphate, ethoxylated oleamine, lauryl pyridinium chloride, N-oleyl-1,3-diaminopropane, stearamidopropyl dimethylamine lactate, coconut fatty amide, oleyl hydroxyethyl imidazoline, isostearyl ethylimidonium ethosulphate, lauramidopropyl PEG-diamonium-chloride phosphate, palmityl trimethylammonium chloride, and cetyltrimethylammonium bromide.

Especially useful surfactants are the fluorocarbon surfactants having a structure of: $F(CF_2)_{4-9}CH_2CH_2SCH_2CH_2N^+R_3X^-$ wherein R is a hydrogen or an alkyl group as described in e.g. U.S. Pat. No. 4,781,985; and having a structure of: $CF_3(CF_2)_mCH_2CH_2O(CH_2CH_2O)_nR$ wherein m=2 to 10; n=1 to 18; R is hydrogen or an alkyl group of 1 to 10 carbon atoms as described in U.S. Pat. No. 5,084,340. These surfactants are commercially available from DuPont and 3M. The concentration of the surfactant component in the receiving layer is typically in the range of 0.1 to 2%, preferably in the range of 0.4 to 1.5% and is most preferably 0.75% by weight based on the total dry weight of the layer.

Furthermore, the constituent receiving layers may be lightly crosslinked to provide such desired features as water-fastness and non-blocking characteristics. However, the degree of cross-linking should be such that neither the diffusion of the functional species or functional species precursor nor the penetration of the lacquer should be substantially affected. Crosslinking is also useful in providing abrasion resistance and resistance to the formation of fingerprints on the element as a result of handling. There are a vast number of known crosslinking agents—also known as hardening agents—that will function to crosslink film forming binders. Hardening agents can be used individually or in combination and in free or in blocked form. A great many hardeners, useful for the present invention, are known, including formaldehyde and free dialdehydes, such as succinaldehyde and glutaraldehyde, blocked dialdehydes, active esters, sulphonate esters, active halogen compounds, isocyanate or blocked isocyanates, polyfunctional isocyanates, melamine derivatives, s-triazines and diazines, epoxides, active olefins having two or more active bonds, carbodiimides, zirconium complexes, e.g. BACOTE 20, ZIRMEL 1000 or zirconium acetate, trademarks of MEL Chemicals, titanium complexes, such as TYZOR grades from DuPont, isoxazolium salts substituted in the 3-position, esters of 2-alkoxy-N-carboxy-dihydroquinoline, N-carbamoylpyridinium salts, hardeners of mixed function, such as halogen-substituted aldehyde acids (e.g. mucochloric and mucobromic acids), onium substituted acroleins and vinyl sulphones and polymeric hardeners, such as dialdehyde starches and copoly(acroleinmethacrylic acid), and oxazoline functional polymers, e.g. EPOCROS WS-500, and EPOCROS K-1000 series, and maleic anhydride copolymers, e.g. GANTREZ AN119.

The constituent receiving layers and the optional supplementary layers used in the information carrier precursor, according to the present invention, may also comprise a plasticizer such as ethylene glycol, diethylene glycol, propylene glycol, polyethylene glycol, glycerol monomethylether, glycerol monochlorohydrin, ethylene carbonate, propylene carbonate, tetrachlorophthalic anhydride, tetrabromophthalic anhydride, urea phosphate, triphenylphosphate, glycerol-monostearate, propylene glycol monostearate, tetramethylene sulphone, n-methyl-2-pyrrolidone, n-vinyl-2-pyrrolidone.

The constituent receiving layers and the optional supplementary layers used in the information carrier precursor, according to the present invention, may also comprise ingredients to improve the lightfastness of the printed image, such as antioxidants, UV-absorbers, peroxide scavengers, singlet oxygen quenchers such as hindered amine light stabilizers, (HALS compounds). Stilbene compounds are a preferred type of UV-absorber.

Receiving Layer Pigment

The receiving layer pigment may be chosen from the inorganic pigments well-known in the art such as silica, talc, clay, hydrotalcite, kaolin, diatomaceous earth, calcium carbonate, magnesium carbonate, basic magnesium carbonate, aluminosilicate, aluminium trihydroxide, aluminium oxide (alumina), titanium oxide, zinc oxide, barium sulphate, calcium sulphate, zinc sulphide, satin white, boehmite (alumina hydrate), zirconium oxide or mixed oxides. In a preferred embodiment the main pigment is chosen from silica, aluminosilicate, alumina, calcium carbonate, alumina hydrate, and aluminium trihydroxide.

According to a sixteenth embodiment of the method for producing an information carrier, according to the present invention, the pigment is an inorganic pigment.

According to a seventeenth embodiment of the method for producing an information carrier, according to the present invention, the pigment is silica.

Refractive indices of these pigments are given in the table below:

| inorganic opacifying pigment | refractive index for sodium line at 589.3 nm |
|---|---|
| silica-silica gel | 1.55 |
| SIPERNAT ® 570 | 1.45 to 1.47 |
| kaolinite | 1.53-1.57 |
| bentonite | 1.557 |
| china clay | 1.56 |
| porous alumina | 1.6 |
| pigment e.g. MARTINOX GL-1 | |

The use of aluminium oxide (alumina) in receiving layers is disclosed in several patents, e.g. in U.S. Pat. No. 5,041,328, U.S. Pat. No. 5,182,175, U.S. Pat. No. 5,266,383, EP 218956, EP 835762 and EP 972650.

Commercially available types of aluminium oxide (alumina) include $\alpha$-$Al_2O_3$ types, such as NORTON E700, available from Saint-Gobain Ceramics & Plastics, Inc, $\gamma$-$Al_2O_3$ types, such as ALUMINUM OXID C from Degussa, Other Aluminium oxide grades, such as BAIKALOX CR15 and CR30 from Baikowski Chemie; DURALOX grades and MEDIALOX grades from Baikowski Chemie, BAIKALOX CR80, CR140, CR125, B105CR from Baikowski Chemie; CAB-O-SPERSE PG003 trademark from Cabot, CATALOX GRADES and CATAPAL GRADES from from Sasol, such as PLURALOX HP14/150; colloidal $Al_2O_3$ types, such as ALUMINASOL 100; ALUMINASOL 200, ALUMINASOL 220, ALUMINASOL 300, and ALUMINASOL 520 trademarks from Nissan Chemical Industries or NALCO 8676 trademark from ONDEO Nalco.

A useful type of alumina hydrate is $\gamma$-AlO(OH), also called boehmite, such as, in powder form, DISPERAL, DISPERAL HP14 and DISPERAL 40 from SASOL, MARTOXIN VPP2000-2 and GL-3 from Martinswerk GmbH.; Liquid boehmite alumina systems, e.g. DISPAL 23N4-20, DISPAL 14N-25, DISPERAL AL25 from SASOL. Patents on alumina hydrate include EP 500021, EP 634286, U.S. Pat. No. 5,624,428, EP 742108, U.S. Pat. No. 6,238,047, EP 622244, EP 810101, etc.

Useful aluminium trihydroxides include Bayerite, or $\alpha$-$Al(OH)_3$, such as PLURAL BT, available from SASOL, and Gibbsite, or $\gamma$-$Al(OH)_3$, such as MARTINAL grades from Martinswerk GmbH, MARTIFIN grades, such as MARTIFIN OL104, MARTIFIN OL 107 and MARTIFIN OL111 from Martinswerk GmbH, MICRAL grades, such as MICRAL 1440, MICRAL 1500; MICRAL 632; MICRAL 855; MICRAL 916; MICRAL 932; MICRAL 932CM; MICRAL 9400 from JM Huber company; HIGILITE grades, e.g. HIGILITE H42 or HIGILITE H43M from Showa Denka K.K., HYDRAL GRADES such as HYDRAL COAT 2, HYDRAL COAT 5 and HYDRAL COAT 7, HYDRAL 710 and HYDRAL PGA, from Alcoa Industrial Chemicals.

A useful type of zirconium oxide is NALCO OOSS008 trademark of ONDEO Nalco, acetate stabilized ZrO2, ZR20/20, ZR50/20, ZR100/20 and ZRYS4 trademarks from Nyacol Nano Technologies. Useful mixed oxides are SIRAL grades from SASOL, colloidal metaloxides from Nalco such as Nalco 1056, Nalco TX10496, Nalco TX11678.

Silica as pigment in receiving elements is disclosed in numerous old and recent patents, e.g. U.S. Pat. No. 4,892,591, U.S. Pat. No. 4,902,568, EP 373573, EP 423829, EP 487350, EP 493100, EP 514633, etc. Different types of silica may be used, such as crystalline silica, amorphous silica, precipitated silica, gel silica, fumed silica, spherical and non-spherical silica, calcium carbonate compounded silica such as disclosed in U.S. Pat. No. 5,281,467, and silica with internal porosity such as disclosed in WO 00/02734. The use of calcium carbonate in receiving layers is described in e.g. DE 2925769 and U.S. Pat. No. 5,185,213. The use of aluminosilicate is disclosed in e.g. DE 2925769. Mixtures of different pigments may be used.

In an alternative embodiment the main pigment can be chosen from organic particles such as polystyrene, polymethyl methacrylate, silicones, melamine-formaldehyde condensation polymers, urea-formaldehyde condensation polymers, polyesters and polyamides. Mixtures of inorganic and organic pigments can be used. However, most preferably the pigment is an inorganic pigment.

The pigment must be present in a sufficient coverage in order to render the receiving layer sufficiently opaque and porous. The lower limit of the ratio by weight of the binder to the total pigment in the receiving layer is preferably about 1:50, most preferably 1:20, while the upper limit thereof is about 2:1, most preferably 1:1. If the amount of the pigment exceeds the upper limit, the strength of the receiving layer itself is lowered, and the resulting image hence tends to deteriorate in rub-off resistance and the like. On the other hand, if the binder to pigment ratio is too great, the ink-absorbing capacity of the resulting receiving layer is reduced, and so the image formed may possibly be deteriorated.

The transparentization process is dependent upon the refraction indices of the pigment on the one hand, and of the lacquer which penetrates the receiving layer (see description below) on the other hand should match each other as closely as possible. The closer the match of the refraction indices the better the transparency which will be obtained after impregnation of the receiver layer with the lacquer.

The most preferred pigment is a silica type, more particularly an amorphous silica having a average particle size ranging from 1 μm to 15 μm, most preferably from 2 to 10 μm. A most useful commercial compound is the amorphous precipitated silica type SIPERNAT 570, trade name from Degussa Co. It is preferably present in the receiving layer in an amount ranging from 5 g/$m^2$ to 30 g/$m^2$. It has following properties:

specific surface area ($N_2$ absorption): 750 $m^2$/g
mean particle size (Multisizer, 100 μm capillarity): 6.7 μm
DBP [DiButyl Phthalate] adsorption: 175-320 g/100 g
refractive index: 1.45 to 1.47.

Other usable precipitated silica types include SIPERNAT 310, 350 and 500, AEROSIL grades (trade mark of Degussa-Hüls AG), and SYLOID types (trade mark from Grace Co.).

The adhesion of receiving layers impregnated with a lacquer according to the method for producing an information carrier, according to the present invention, to the rigid sheet or support undergoes a strong improvement upon subsequent curing e.g. UV-hardening.

Receiving Layer Binder

The receiving layer binder(s) can be water-soluble, solvent soluble or a latex and can be chosen from a list of compounds well-known in the art including hydroxyethyl cellulose; hydroxypropyl cellulose; hydroxyethylmethyl cellulose; hydroxypropyl methyl cellulose; hydroxybutylmethyl cellulose; methyl cellulose; sodium carboxymethyl cellulose; sodium carboxymethylhydroxethyl cellulose; water soluble ethylhydroxyethyl cellulose; cellulose sulphate; polyvinyl alcohol; vinylalcohol copolymers; polyvinyl acetate; polyvinyl acetal; polyvinyl pyrrolidone; polyacrylamide; acrylamide/acrylic acid copolymer; polystyrene, styrene copolymers; acrylic or methacrylic polymers; styrene/acrylic copolymers; ethylene-vinylacetate copolymer; vinylmethyl ether/maleic acid copolymer; poly(2-acrylamido-2-methyl propane sulphonic acid); poly(diethylene triamine-co-adipic acid); polyvinyl pyridine; polyvinyl imidazole; polyethylene imine epichlorohydrin modified; polyethylene imine ethoxylated; polyethylene oxide; polyurethane; melamine resins; gelatin; carrageenan; dextran; gum arabic; casein; pectin; albumin; starch; collagen derivatives; collodion and agar-agar.

A preferred binder for the practice of the present invention is a polyvinylalcohol (PVA), a vinylalcohol copolymer or modified polyvinyl alcohol. Most preferably, the polyvinyl alcohol is a silanol modified polyvinyl alcohol. Most useful commercially available silanol modified polyvinyl alcohols can be found in the POVAL R polymer series, trade name of Kuraray Co., Japan. This R polymer series includes the grades R-1130, R-2105, R-2130, R-3109, which differ mainly in the viscosity of their respective aqueous solutions. The silanol groups are reactive to inorganic substances such as silica or alumina. R-polymers can be easily crosslinked by changing the pH of their aqueous solutions or by mixing with organic substances and can form water resistant films.

According to an eighteenth embodiment of the method for producing an information carrier, according to the present invention, the receiving layer configuration comprises at least one latex in at least one receiving layer. Upon varying the pigment/latex ratio between 2 and 6.5 (2, 2.2, 2.45, 2.70, 2.75, 3.5, 3.78, 4.25, 5 and 6.25) with SYLOID® W-300 as pigment it was found that the amount of ink bleeding decreased with increasing pigment/latex ratio. At too high ratios of pigment/latex the receiving layer becomes too powdery. With SYLOID® W-300 the best image sharpness was observed at a weight ratio of total pigment to total latex of 3.29. Furthermore, the presence of very high latex concentrations prohibitively reduces the rub-resistance of the printed image.

According to a nineteenth embodiment of the method for producing an information carrier, according to the present invention, the receiving layer configuration comprises at least one latex in at least one receiving layer and the weight ratio of total pigment to total latex is in the range 3:1 to 6.5:1.

As the latex concentration in the outermost receiving layer in the receiving layer configuration increases ink-jet images printed on the outermost receiving layer bleeding of the ink-jet ink increases and as a result the raster of the ink-jet image is lost in favour of continuous tone imaging. Alternatively as the latex concentration in the outermost receiving layer decreases ink-jet images on the outermost receiving layer become sharper and sharper. The best image quality was found with a total pigment to total latex of 3.29:1 in the case of SYLOID® W-300 as pigment.

Layer or Element Capable of a Machine-Readable Change

The information carrier precursor used in the methods for producing an information carrier comprises a layer or element capable of a machine-readable change upon absorbing UV, visible or IR radiation and the methods incorporate a step in which a light source is used to write a pattern in the layer or element capable of a machine-readable change upon absorption of UV, visible or IR radiation.

Lasers suitable for realizing the human-readable or machine-readable change are Nd-YAG, carbon dioxide and diode lasers e.g. AlGaAs laser diodes.

According to a twentieth embodiment of the method for producing an information carrier, according to the present invention, the machine-readable change is an inductive, magnetic or electrical change.

According to a twenty-first embodiment of the method for producing an information carrier, according to the present invention, the layer or element capable of a machine-readable change upon absorbing IR-radiation comprises a polymer resin.

According to a twenty-second embodiment of the method for producing an information carrier, according to the present invention, the layer or element capable of a machine-readable change upon absorbing IR-radiation comprises a ferroelectric polymer.

According to a twenty-third embodiment of the method for producing an information carrier, according to the present invention, the layer or element capable of a machine-readable change upon absorbing IR-radiation comprises an intrinsically conductive polymer e.g. a polythiophene, such as poly (3,4-ethylenedioxy-thiophene), a polyaniline, a polyacetylene or a polypyrrole.

According to a twenty-fourth embodiment of the method for producing an information carrier, according to the present invention, the layer or element capable of a machine-readable change upon absorbing IR-radiation comprises a metal.

Rigid Sheet or Support

According to a twenty-fifth embodiment of the method for producing an information carrier, according to the present invention, the rigid sheet or support comprises at least one layer and/or a multilayer laminate or co-extrudate. Examples of suitable co-extrudates are PET/PETG and PET/polycarbonate.

The support can be a sheet or web support. According to a seventeenth embodiment of the information carrier precursor, according to the present invention, the support is a web support.

The support for use in the present invention can be transparent, translucent or opaque, and can be chosen from paper type and polymeric type supports well-known from photographic technology. Paper types include plain paper, cast coated paper, polyethylene coated paper and polypropylene coated paper. Polymeric supports include cellulose acetate propionate or cellulose acetate butyrate, polyesters such as polyethylene terephthalate and polyethylene naphthalate, polyamides, polycarbonates, polyimides, polyolefins, poly (vinylacetals), polyethers and polysulfonamides. Other examples of useful high-quality polymeric supports for the present invention include opaque white polyesters and extrusion blends of polyethylene terephthalate and polypropylene. Polyester film supports and especially polyethylene terephthalate are preferred because of their excellent properties of dimensional stability. When such a polyester is used as the support material, a subbing layer may be employed to improve the bonding of the receiving layer configuration to the support. Useful subbing layers for this purpose are well known in the photographic art and include, for example, polymers of vinylidene chloride such as vinylidene chloride/ acrylonitrile/acrylic acid terpolymers or vinylidene chloride/methyl acrylate/itaconic acid terpolymers.

In a most preferred embodiment of the present invention the support is coloured or whitened polyvinyl chloride or polyethylene terephthalate or polycarbonate.

Non-Transparentizing Lacquer Composition

The term "non-transparentizing lacquer", as used in disclosing the present invention, means a liquid under the application conditions, which comprises at least one polymer and/or at least one wax and can solidify upon cooling, become solid upon evaporation of solvent or harden/cross-link upon exposure to heat, moisture or radiation e.g. visible light, UV-radiation and electron beams i.e. is curable which does not transparentize the receiving layer configuration.

The substantial penetration of the receiving layer configuration by the non-transparentizing lacquer can be realized by controlling the penetration time and/or the viscosity of the composition. The viscosity of the non-transparentizing lacquer composition is adjusted to ensure rapid penetration and hence rapid permanent opacity.

According to a twenty-sixth embodiment of the method for producing an information carrier, according to the present invention, in the event of pattern-wise transparentization of the receiving layer configuration, the non-transparentized areas of the receiving layer configuration are penetrated with a non-transparentizing lacquer.

According to a twenty-seventh embodiment of the method for producing an information carrier, according to the present invention, the non-transparentizing lacquer is a curable lacquer e.g. thermally curable, electron beam curable or photopolymerizable.

According to a twenty-eighth embodiment of the method for producing an information carrier, according to the present invention, the lacquer is a radiation curable lacquer.

According to a twenty-ninth embodiment of the method for producing an information carrier, according to the present invention, the non-transparentizing lacquer is a photopolymerizable lacquer.

Avoidance of transparentization depends upon the refraction indices of the pigment and of the lacquer which penetrates the receiving layer configuration not matching each other with the refractive index difference being greater than 0.12. Therefore, the choice of ingredients for the lacquer has to be such as to fulfil this requirement. Additional constraints on the composition of the lacquer are determined by whether the non-transparentizing lacquer is required to be curable and if curable which curing process has been selected.

According to a thirtieth embodiment of the method for producing an information carrier, according to the present invention, the refractive index of the pigment and the refractive index of the non-transparentizing lacquer differ by more than 0.12.

Refractive indices of representative polymers are given below:

| | Refractive index for sodium line at 589.3 nm [ASTM D642] |
|---|---|
| polystyrene | 1.57-1.60 |
| poly(4-methoxystyrene) | 1.5967 |
| polyvinylidene chloride | 1.60 |
| poly-α-methyl-styrene | 1.610 |
| poly-α-vinyl-naphthalene | 1.6818 |
| Polyvinyl carbazole | 1.695 |

The refractive index of curable lacquers based on styrenes are typically ca. 1.60 and hence the use of such compositions as lacquers, according to the present invention, will provide a good match with the refractive index of SIPERNAT 570 with a refractive index of 1.45 to 1.47, and hence no transparency is obtained. Lacquers with even higher refractive indices are possible e.g. those including N-vinyl carbazole as comonomer. Alternatively the use of acrylate/methacrylate-based lacquers with a refractive index of 1.47 to 1.49 with receiving layer configurations comprising a porous alumina pigment such as MARTINOX GL-1 with a refractive index of 1.6 also ensures that no transparency is obtained.

Transparentizing Lacquer Composition

The transparentization process depends upon the refractive index of the pigment in the opaque and porous layer and the refractive index of the lacquer which penetrates the opaque and porous constituent layer or layers of the receiving layer configuration matching each other as closely as possible. The closer the match of the refraction indices, the better the transparency which will be obtained after impregnation of the receiver layer with the lacquer. Therefore, the choice of ingredients for the lacquer has to be such as to fulfil this requirement. Additional constraints on the composition of the lacquer are determined by whether the lacquer is required to be curable and if curable which curing process has been selected.

In a transparentizing lacquer the refractive index of the pigment and the refractive index should differ by no more than 0.1, preferably by not more than 0.04 and particularly preferably by no more than 0.02.

Refractive indices of representative polymers are given below:

| | Refractive index for sodium line at 589.3 nm [ASTM D642] |
|---|---|
| polystyrene | 1.57-1.60 |
| poly-α-methyl-styrene | 1.610 |
| poly-α-vinyl-naphthalene | 1.6818 |
| polyacrylonitrile | 1.514, 1.5187 |
| polymethacrylonitrile | 1.520 |
| polymethyl methacrylate | 1.49, 1.4893 |
| polyacrylamide | — |
| copolymer of acrylonitrile and styrene | 1.56-1.57, 1.57 |
| copolymer of 28.5 wt % acrylonitrile and 71.5 wt % styrene | 1.56-1.57, 1.57 |

The use of typical UV-curable lacquers, such as acrylate/methacrylate-based lacquers, have a refractive index of 1.47 to 1.49 which provides a good match of refractive index with SIPERNAT® 570 with a refractive index of 1.45 to 1.47 and hence penetration of receiving layer configurations comprising SIPERNAT® 570 with such lacquers results in good transparency.

The substantial penetration of the receiving layer configuration by the transparentizing lacquer can be realized by controlling the penetration time and/or the viscosity of the composition. The viscosity of the transparentizing lacquer is adjusted to ensure rapid penetration and hence rapid transparentization.

The transparentizing lacquer is preferably a curable lacquer e.g. thermally curable, electron beam curable or photopolymerizable, with a radiation curable lacquer being preferred and a photopolymerizable lacquer being particularly preferred.

Curable Lacquer Ingredients

An essential ingredient of a curable lacquer is at least one monomer. In the case of the curable lacquer being a photopolymerizable lacquer the lacquer will further contain at least one photoinitiator.

Suitable monomers for use in curable lacquers include the monomers disclosed in DE-OS 4005231, DE-OS 3516256, DE-OS 3516257, DE-OS 3632657 and U.S. Pat. No. 4,629,676, unsaturated esters of polyols, particularly such esters of the α-methylene carboxylic acids, e.g. ethylene diacrylate, glycerol tri(meth)acrylate, diethylene glycol di(meth)acrylate, 1,3-propanediol di(meth)acrylate, 1,2,4-butanetriol tri(meth)acrylate, 1,4-cyclohexanediol di(meth)acrylate, 1,4-benzenediol di(meth)acrylate, pentaerythritol tetra(meth)acrylate, pentaerythritol triacrylate, dipentaerythritol pentacrylate, trimethylolpropane triacrylate, 1,5-pentadiol di(meth)acrylate, the bis-acrylates and bis-methacrylates of polyethylene glycols of molecular weight 200-500; unsaturated amides, particularly those of the α-methylene carboxylic acids, and especially those of α,ω-diamines and oxygen-interrupted ω-diamines, such as bis-acrylamide, methylene bis-methacrylamide, 1,6-hexamethylene bis-acrylamide, diethylene triamine tris-methacrylamide, bis(γ-methacrylamidopropoxy)ethane, β-methacryl-amidoethyl methacrylate, N-(β-hydroxyethyl)-β-(methacrylamido)ethyl acrylate, and N,N-bis(β-methacryloyl-oxyethyl)acrylamide; vinyl esters, e.g. divinyl succinate, divinyl adipate, divinyl phthalate, divinyl butane-1,4-disulphonate; and unsaturated aldehydes, e.g. sorbaldehyde (hexadienal).

Curable lacquers may also comprise polymers and/or oligomers comprising two or more different polymerizable functions, e.g. acrylated epoxies, polyester acrylates, urethane acrylates, etc.

It is also possible to use monofunctional (meth)acrylic acid esters as monomer provided they are not too volatile and do not spread an unwanted odour. Suitable compounds include n-octylacrylate, decylacrylate, decylmethacrylate, stearylacrylate, stearylmethacrylate, cyclohexylacrylate, cyclohexylmethacrylate, phenylethylacrylate, phenylethylmethacrylate. The most preferred compounds comprise one or more (meth)acrylate functional groups.

Preferred monomers for use in UV-curable photopolymerizable compositions have at least one (meth)acrylate functional group, such as those disclosed in EP-A 0 502 562.

A wide variety of photopolymerizable and photocrosslinkable compounds can be used in the present invention. Suitable photoinitiators include all compounds or compound combinations known for this purpose. Examples are benzoin ethers, benzil ketals, polycyclic quinones, benzophenone derivatives, triarylimidazolyl dimers, photosensitive trihalomethyl compounds, for example trichloromethyl-s-triazines. Preferred photoinitiators are the 2,3-bisarylquinoxalines, as disclosed in U.S. Pat. No. 3,765,898, and 2-aryl-4,6-bistrichloromethyl-s-triazines. The amount of photoinitiator or photoinitiator combination is generally between 1 and 25% by weight of the photopolymerizable composition and preferably between 5 and 15% by weight.

Photopolymerizable lacquers may also contain a minor amount of a heat polymerization inhibitor which prevents premature polymerization before the UV curing step. Examples of such inhibitors include p-methoxyphenol, hydroquinone, aryl- or alkyl substituted hydroquinone, t-butylcatechol, pyrogallol, copper(I) chloride, phenothiazine, chloranil, naphtylamine, α-naphthol, 2,6-di-t-butyl-p-cresol, etc. A preferred polymerization inhibitor is 2-methyl hydroquinone. The heat polymerization inhibitors are preferable used in an amount of 0.001 to 5 parts by weight per 100 parts of monomer.

Curable lacquers may optionally contain a minor amount of organic solvent, e.g. ethyl acetate. Suitable solvents for use in the transparentizing curable compositions used in the method for producing an information carrier, according to the present invention, include the following commercially available compounds (chemical and commercial names).

According to a thirty-first embodiment of the method for producing an information carrier, according to the present invention, the lacquer further contains at least one colorant e.g. a dye or a pigment.

Information Carrier

According to a thirty-second embodiment of the method for producing an information carrier, according to the present invention, the information carrier is an identification card selected from the group consisting of an identity card, a security card, a driver's license card, a social security card, a health card, a membership card, a time registration card, a bank card, a pay card and a credit card.

Most types of ID cards have now the standardized dimensions of 85.6 mm×54.0 mm×0.76 mm. This final thickness can be reached by thermal lamination of one or more polymeric foils, e.g. PVC foils. The finished ID card can serve as an identity card, a security card, a driver's license card, a social security card, a bank card, a membership card, a time registration card, a pay card and a credit card, etc.

Apart from the features described above the finished ID card may comprise additional security elements or information carriers such as a hologram, a magnetic strip, or a chip ("smart cards").

According to a thirty-third embodiment of the method for producing an information carrier, according to the present invention, the information carrier is in the form of a flexible sheet e.g. any page of a passport or a page of a passport with personalized data of the bearer.

According to a thirty-fourth embodiment of the method for producing an information carrier, according to the present invention, the information carrier is an admission document e.g. a visa, a ticket for an event and lottery tickets.

Applications

The method for producing an information carrier, according to the present invention, can be utilized in the security field not only encompassing personalized documents such as passports, driving licenses, identity cards (ID cards) and admission documents such as visa's and entry tickets, but also the authentification and identification of goods to avoid counterfeiting, tampering and fraud such as lottery tickets, share certificates, transaction documents, labels on luggage and the packaging of pharmaceuticals and high value products in general.

The present invention will now be illustrated by the following examples without however being limited thereto. The percentages and ratios given in these examples are by weight unless otherwise indicated.

EXAMPLES

Ingredients used in the Examples

| | |
|---|---|
| PI (Photoinitiator) 01 | 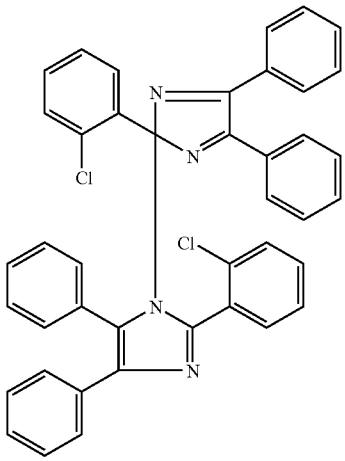 |
| Leuco crystal violet | 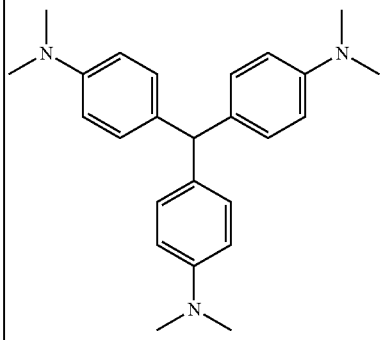 |

Invention Example 1

A 100 μm thick sheet of transparent polyethylene terephthalate subbed with subbing layer No 1 was coated with the porous receiver layer dispersion with the composition given in table 1:

TABLE 1

| Composition of porous receiver layer dispersion | |
|---|---|
| Syloid ™ W300, a colloidal silica from GRACE GMBH | 75.6 g |
| Poval ™ PVA R3109, a silanol modified polyvinyl alcohol from KURARAY CO. | 2.3 g |
| Catfloc ™ T2, a cationic polyelectrolyte from CALGON EUROPE | 5.6 g |
| Bronidox ™ K, a biocide from HENKEL (5% solution in ethanol) | 0.3 g |

TABLE 1-continued

| Composition of porous receiver layer dispersion | |
|---|---|
| Citric acid | 0.3 g |
| Polysol ™ EVA P-550, a 50% aqueous emulsion of an ethylene-vinyl acetate-vinyl versatate copolymer from SHOWA HIGH POLYMER CO. | 100 g |
| Aerosol ™ OT, a surfactant from CYTEC | 1.5 g |
| Tergitol ™ 4, a surfactant from UNION CARBIDE | 1 g |
| Water to make | 1000 g |

using a 100 μm wirebar followed by drying at 50° C. producing an opaque porous layer with a layer thickness of 22 μm and an optical density of 0.19 measured with a MacBeth RB918-SB densitometer with a visible filter and with a black sheet of cardboard with a density of 1.35 placed under the transparent polyethylene terephthalate support. With a white background beneath the transparent polyethylene terephthalate support an optical density of 0.06 was measured with a visible filter indicating a certain transparency, although the "opaque" porous layer provides a white non-transparent film due to the extremely high haze of the layer of 97% as measured with a Haze-Gard Plus apparatus from BYK-GARDNER according to ASTM D1003.

Model experiments were carried out with liquids to determine what refractive index difference was acceptable with the above-described opaque porous layer without a prohibitive decrease in optical density (OD). The results are given in Table 2 together with the optical density obtained upon transparentization with the lacquer with the composition given in Table 3 below:

TABLE 2

| Liquid | Refractive index at 20° C. with sodium line at 589.3 nm | OD (visible filter/black background) of "opaque" porous layer upon wetting with the liquid |
|---|---|---|
| deionized water | 1.3325 | 0.70 |
| methylethylketone | 1.379 | 1.13 |
| dichloromethane | 1.4241 | 1.26 |
| toluene | 1.497 | 1.37 |

On the basis of the optical density achieved with the lacquer given in Table 3, extrapolation gives a value for the refractive index of the pigment in the opaque porous layer of ca. 1.52.

Invention Example 2

The photosensitive elements used in INVENTION EXAMPLE 2 were prepared by coating the solution in Table 3 below onto polyethylene paper to a wet thickness of 100 μm. After allowing the layers to dry for 2 minutes at room temperature the layers were dried in a drying cupboard at 50° C. for 3 minutes.

TABLE 3

| | Photosensitive element 1 | Photosensitive element 2 | Photosensitive element 3 |
|---|---|---|---|
| acetone [g] | 40 | 40 | 40 |
| 2-butanone [g] | 40 | 40 | 40 |
| Dodecyl benzylsulphonic acid [g] | 0.7 | — | 0.7 |
| Leuco crystal violet | 0.4 | 0.4 | 0.4 |
| Photoinitiator PI 01 | 0.6 | 0.6 | 0.6 |

TABLE 3-continued

| | Photo-sensitive element 1 | Photo-sensitive element 2 | Photo-sensitive element 3 |
|---|---|---|---|
| 2-mercaptobenzoxazole [g] | — | — | 0.2 |
| Cellulose acetate butyrate: CAB 381-20 from EASTMAN [g] | 10 | 10 | 10 |
| | 91.5 | 90.8 | 91.7 |

Photosensitive elements 1 to 3 were exposed through a grey level wedge with a constant of 0.15 with different light sources and different exposure times: 180 s and 360 s in contact with a UV-A lightbox with 8 Philips TL 20 W/10 UVA tubes, 600 s in contact with a DL3000SP UV-source in vacuum and 300 s with the DL3000SP but under glass and very near the lamp. The optical densities before and after the different exposures were measured in transmission through a red filter with a Macbeth RD918-SB densitometer. The results are summarized in Table 4.

TABLE 4

| | Optical density through a red filter | | | | |
|---|---|---|---|---|---|
| Photo-sensitive element nr | prior to exposure | after 180 s exposure under glass with UVA | after 360 s exposure under glass with UVA | after 600 s DL300SP exposure under vacuum | after 300 s DL300SP exposure very near lamp and under glass |
| 1 | 0.44 | 1.03 | 1.21 | 1.05 | 1.68 |
| 2 | 0.24 | 0.34 | 0.37 | 0.36 | 0.94 |
| 3 | 0.42 | 0.81 | 0.93 | 0.89 | 1.73 |

An isopropanol droplet was applied to a sheet with a porous layer on a 100 μm thick subbed transparent polyethylene terephthalate support prepared as described in INVENTION EXAMPLE 1 and the sheet covered with a 23 μm thick PET-film. The optical density of the thereby transparentized sheet with a porous layer on a black background monitored at one minute intervals are given in Table 5.

TABLE 5

| time elapsed since application isopropanol droplet [min] | Optical density of sheet with macro-porous layer on a black background |
|---|---|
| 0 | 1.12 |
| 1 | 1.11 |
| 2 | 1.10 |
| 3 | 1.10 |
| 4 | 1.10 |
| 5 | 1.10 |
| 6 | 1.10 |
| 7 | 1.10 |
| 8 | 1.10 |
| 9 | 1.10 |
| 10 | 1.10 |
| 11 | 1.10 |

These results show that the density remained substantially unchanged over a period of 10 minutes.

A sandwich was realized by placing the uncoated side of the sheet with the porous layer on the coated side of photosensitive element and after application of a droplet of liquid placing a 23 μm thick PET-film over the porous layer. Photosensitive element 1 in the sandwich was then exposed for 300 s on the UVA lightbox with 8 Philips TL 20 W/10 UVA tubes. This experiment was carried out twice and the optical density of photosensitive element 1 after exposure measured through a red filter in transmission with a Macbeth RD918-SB densitometer. The optical densities realized with the different liquids in the two experiments are given in Table 6.

TABLE 6

| | | Optical density through a red filter | | |
|---|---|---|---|---|
| | refractive index of | Prior to | after 360 s UVA exposure under glass | |
| liquid | liquid | exposure | experiment 1 | experiment 2 |
| none | — | 0.52 | 1.00 | 1.05 |
| methanol | 1.328 | 0.52 | 1.21 | 1.33 |
| water | 1.333 | 0.52 | 1.15 | 1.16 |
| ethanol | 1.361 | 0.52 | 1.22 | 1.34 |
| toluene | 1.496 | 0.52 | 1.25 | 1.34 |

These experiments clearly show that the optical densities realized upon exposing Photosensitive element 1 though a with liquid transparentized porous layer were significantly higher than the optical densities realized upon exposing Photosensitive element 1 though the porous layer without transparentization with a liquid despite the improvised nature of the experiment.

Therefore, security information can be applied using a light-source, such as a laser, in a layer or pattern beneath a porous layer, by applying the security information with the porous layer in a temporarily transparentized state and then rendering the porous layer opaque so that the added security information cannot be visually detected. Such information could, for example, be inductively readable information and the pattern beneath the porous layer could be a pattern of an intrinsically conductive polymer, such as poly(3,4-ethylenedioxythiophene) (PEDOT).

Invention Examples 3

A 100 μm thick sheet of transparent polyethylene terephthalate subbed with subbing layer 1 was coated with the porous receiver layer dispersion with the composition given in Table 1 of INVENTION EXAMPLE 1 using a 100 μm wirebar followed by drying at 50° C. producing an opaque porous layer with a layer thickness of 22 μm and an optical density of 0.19 measured with a MacBeth RB918-SB densitometer with a visible filter and with a black sheet of cardboard with a density of 1.35 placed under the transparent polyethylene terephthalate support. With a white background beneath the transparent polyethylene terephthalate support an optical density of 0.06 was measured with a visible filter indicating a certain transparency, although the "opaque" porous layer provides a white non-transparent film due to the extremely high haze of the layer of 97% as measured with a Haze-Gard Plus apparatus from BYK-GARDNER according to ASTM D1003.

A sheet of MASTERTOOL™ MT8 from AGFA-GEVAERT N.V., an evaporated bismuth layer on a PET-support with a protective layer, was attached to the above-described porous layer-coated sheet with its support in contact with the protective layer of the sheet of MASTERTOOL™ MT8. A drop of liquid was then applied to the porous layer and a 23 μm thick attached to the surface of the thereby moistened porous layer. This configuration was then exposed to a NdYLF laser at 1047 nm in a laser-exposure unit with the porous layer uppermost at a scanning speed of 2 m/s at an intensity of $1.18\times10^5$ W/cm$^2$ (power=450 mW and spot-width=22 μm). The optical density of the bismuth layer was measured with a Macbeth TD 904 densitometer in transmission with a visible filter: prior to exposure, with unmoistened porous layer, with the porous layer moistened with water and with the porous layer moistened with diethylene glycol. The results are summarized in Table 7:

TABLE 7

| | Refractive index of liquid at 20° C. | Optical density measured in transmission with a MacBeth TD904 densitometer |
|---|---|---|
| Before exposure | — | 3.96 |
| Exposure of Mastertool MT8 sheet through unmoistened porous layer | — | 3.96 |
| Exposure of Mastertool MT8 sheet through porous layer moistened with water | 1.333 | 1.33 |
| Exposure to Mastertool MT8 sheet through porous layer moistened with diethylene glycol | 1.4475 | 0.80 |

These experiments clearly show that no optical density reduction due to bismuth coalescence was realized upon exposing the sheet of Mastertool MT8 though the porous layer itself, whereas substantial reductions in optical density from 4.96 to 1.33 and 0.80 respectively were observed upon exposure through a with liquid transparentized porous layer for water and diethylene glycol respectively. Moreover, a much high reduction in optical density was observed with diethylene glycol-induced transparentization than with water-induced transparentization, which is consistent with the refractive index of diethylene glycol of 1.4475 being much closer to that of silica that that of water of 1.333.

Therefore, security information can be applied using a light-source, such as a laser, in a layer or pattern beneath a porous layer, by applying the security information with the porous layer in a temporarily transparentized state and then rendering the porous layer opaque so that the added security information cannot be visually detected. Such information could, for example, be inductively readable information and the pattern beneath the porous layer could be a pattern of an intrinsically conductive polymer, such as poly(3,4-ethylenedioxythiophene)(PEDOT).

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A method for producing an information carrier comprising the steps of: (1) providing an information carrier precursor comprising a rigid sheet or support; a receiving layer configuration having an image-receiving side and a non-image-receiving side, said receiving layer configuration comprising at least one pigment and at least one binder, wherein at least one constituent layer of said receiving layer configuration is opaque; at least the outermost layer on the image-receiving side or a layer in diffusive contact with the outermost layer on the image-receiving side is opaque and porous; and said receiving layer configuration is capable of being rendered substantially transparent by penetration by a lacquer; and a layer or element, or pattern in said layer or element, capable of a machine-readable change upon absorbing UV, visible or IR radiation, said layer or element being either the surface of said rigid sheet or support or interposed between said rigid sheet or support and the non-image-receiving side of said receiving layer configuration; (2) pattern-wise or integrally at least partially transparentizing the receiving layer configuration with a vaporizable liquid thereby providing a transparent pattern on said at least partially transparentized receiving layer; (3) using a light source to write a pattern or modify said pattern in the layer or element capable of a machine-readable change upon absorption of UV, visible or IR radiation after transmission through at least part of the transparentized areas of the receiving layer configuration; evaporating said vaporizable liquid; and after said vaporizable liquid has been evaporated pattern-wise or integrally rendering said receiving layer configuration permanently at least partially non-transparent with a non-transparentizing lacquer, thereby producing an information carrier, wherein the refractive index of the pigment and the refractive index of the non-transparentizing lacquer differ by greater than 0.12.

2. The method according to claim 1, wherein said method further comprises applying a pattern to said outermost layer of said receiving layer configuration.

3. The method according to claim 2, wherein said application of said pattern to said outermost layer is performed subsequent to said writing of said pattern in said layer or element capable of a machine-readable change upon absorption of UV, visible or IR radiation.

4. The method according to claim 1, wherein said rigid sheet or support comprises at least one layer and/or a multi-layered laminate or extrudate.

5. The method according to claim 1, wherein said light source is a laser.

6. A method for producing an information carrier comprising the steps of: (1) providing an information carrier precursor comprising a rigid sheet or support; a receiving layer configuration having an image-receiving side and a non-image-receiving side, said receiving layer configuration comprising at least one pigment and at least one binder, wherein at least one constituent layer of said receiving layer configuration is opaque; at least the outermost layer on the image-receiving side or a layer in diffusive contact with the outermost layer on the image-receiving side is opaque and porous; and said receiving layer configuration is capable of being rendered substantially transparent by penetration by a lacquer; and a layer or element, or pattern in said layer or element, capable of a machine-readable change upon absorbing UV, visible or IR radiation, said layer or element being either the surface of said rigid sheet or support or interposed between said rigid sheet or support and the non-image-receiving side of said receiving layer configuration; (2) pattern-wise or integrally at least partially transparentizing the receiving layer configuration with a vaporizable liquid thereby providing a transparent pattern on said at least partially transparentized receiving layer; (3) using a light source to write a pattern or modify said pattern in the layer or element capable of a machine-readable change upon absorption of UV, visible or IR radiation after transmission through at least part of the transparentized areas of the receiving layer configuration; evaporating said vaporizable liquid; and after said vaporizable liquid has been evaporated pattern-wise or integrally rendering said receiving layer configuration permanently at least partially non-transparent with a non-transparentizing lacquer, thereby producing an information carrier, wherein said machine-readable change is an inductive, magnetic or electrical change.

7. The method according to claim 1, wherein a permanent pattern is applied to the outermost surface of said receiving layer using a conventional printing technique.

8. The method according to claim 1, wherein the parts of the receiving layer configuration not covering said pattern in the layer or element capable of a machine-readable change upon absorbing UV, visible or IR radiation are permanently transparentized by a transparentizable lacquer.

9. The method according to claim 1, wherein, in the event of pattern-wise transparentization of said receiving layer configuration, said non-transparentized areas of said receiving layer configuration are penetrated with a non-transparentizing lacquer.

10. The method according to claim 1, wherein said layer or element capable of a machine-readable change upon absorbing IR-radiation comprises a polymer resin.

11. A method for producing an information carrier comprising the steps of: (1) providing an information carrier precursor comprising a rigid sheet or support; a receiving layer configuration having an image-receiving side and a non-image-receiving side, said receiving layer configuration comprising at least one pigment and at least one binder, wherein at least one constituent layer of said receiving layer configuration is opaque; at least the outermost layer on the image-receiving side or a layer in diffusive contact with the outermost layer on the image-receiving side is opaque and porous; and said receiving layer configuration is capable of being rendered substantially transparent by penetration by a lacquer; and a layer or element, or pattern in said layer or element, capable of a machine-readable change upon absorbing UV, visible or IR radiation, said layer or element being either the surface of said rigid sheet or support or interposed between said rigid sheet or support and the non-image-receiving side of said receiving layer configuration; (2) pattern-wise or integrally at least partially transparentizing the receiving layer configuration with a vaporizable liquid thereby providing a transparent pattern on said at least partially transparentized receiving layer; (3) using a light source to write a pattern or modify said pattern in the layer or element capable of a machine-readable change upon absorption of UV, visible or IR radiation after transmission through at least part of the transparentized areas of the receiving layer configuration; evaporating said vaporizable liquid; and after said vaporizable liquid has been evaporated pattern-wise or integrally rendering said receiving layer configuration permanently at least partially non-transparent with a non-transparentizing lacquer, thereby producing an information carrier, wherein said layer or element capable of a machine-readable change upon absorbing IR-radiation comprises a polymer resin, and wherein said polymer resin is a ferroelectric polymer.

12. The method according to claim 10, wherein said polymer resin is an intrinsically conductive polymer.

13. The method according to claim 1, wherein said layer or element capable of a machine-readable change upon absorbing IR-radiation comprises a metal.

14. The method according to claim 1, wherein said information carrier precursor further comprises an opaque element between the side of said receiving layer configuration nearer said support and said support.

15. The method according to claim 1, wherein said pigment is an inorganic pigment.

16. The method carrier precursor according to claim 15, wherein said inorganic pigment is silica.

17. The method according to claim 1, wherein said information carrier is an identification card selected from the group consisting of an identity card, a security card, a driver's license card, a social security card, a health card, a membership card, a time registration card, a bank card, a pay card and a credit card.

* * * * *